US007594373B2

(12) United States Patent
Abergel

(10) Patent No.: US 7,594,373 B2
(45) Date of Patent: Sep. 29, 2009

(54) PACKAGING A PRODUCT AND PACKAGING METHOD

(75) Inventor: Aline Abergel, Boulogne (FR)

(73) Assignee: L'Oreal, Paris (FR)

( * ) Notice: Subject to any disclaimer, the term of this patent is extended or adjusted under 35 U.S.C. 154(b) by 999 days.

(21) Appl. No.: 10/698,415

(22) Filed: Nov. 3, 2003

(65) Prior Publication Data

US 2004/0139703 A1 Jul. 22, 2004

Related U.S. Application Data

(60) Provisional application No. 60/428,709, filed on Nov. 25, 2002, provisional application No. 60/428,705, filed on Nov. 25, 2002.

(30) Foreign Application Priority Data

Nov. 4, 2002 (FR) ..... 02 13758
Nov. 4, 2002 (FR) ..... 02 13759

(51) Int. Cl.
*B65B 1/02* (2006.01)
*B65B 7/23* (2006.01)
*B65B 7/28* (2006.01)

(52) U.S. Cl. ..... 53/467; 53/471; 206/823; 206/581

(58) Field of Classification Search ..... 132/301–306, 132/316, 291; 206/484, 823, 581, 235, 542; 53/467, 471, 491
See application file for complete search history.

(56) References Cited

U.S. PATENT DOCUMENTS 2,061,139 A 11/1936 Cohen
3,900,125 A * 8/1975 Wyler et al. ..... 215/341
4,220,244 A * 9/1980 Elmore ..... 206/210
4,469,226 A * 9/1984 Matney ..... 206/470
4,491,389 A * 1/1985 Coburn, Jr. ..... 359/848
4,786,534 A 11/1988 Aiken
4,890,872 A * 1/1990 Parrotta et al. ..... 283/56
5,161,688 A 11/1992 Muchin (Continued)

FOREIGN PATENT DOCUMENTS

EP 0722676 7/1996

(Continued)

*Primary Examiner*—Rinaldi I. Rada
*Assistant Examiner*—Gloria R. Weeks
(74) *Attorney, Agent, or Firm*—Oblon, Spivak, McClelland, Maier & Neustadt, L.L.P.

(57) ABSTRACT

A device for packaging a product, particularly a make-up product. The device can be particularly advantageous for make-up samples, and includes a support preferably having a flat overall shape and two faces. The support has at least one cavity which opens onto at least one face through a first opening passing through the support, with the cavity containing the product. A lid is also provided, preferably also having a flat overall shape. The support and the lid are articulated by an articulation arrangement formed by: i) a sticker forming a mirror adhesively bonded onto one of the faces of the lid and onto one of the faces of the support; and/or ii) an adhesive sheet fixed onto one face of the lid and onto one of the faces of the support with the adhesive sheet closing off a second opening of the cavity, which is formed on the face of the support opposite from the face containing the first opening.

11 Claims, 6 Drawing Sheets

U.S. PATENT DOCUMENTS

| | | | | |
|---|---|---|---|---|
| 5,295,580 | A * | 3/1994 | Hicks | 206/588 |
| 5,514,442 | A * | 5/1996 | Galda et al. | 428/78 |
| 5,931,169 | A * | 8/1999 | Kervoalen | 132/294 |
| 5,944,188 | A * | 8/1999 | Grosskopf et al. | 206/466 |
| 6,108,957 | A * | 8/2000 | Zapawa | 40/654.01 |
| 6,199,559 | B1 * | 3/2001 | Nikolaus et al. | 132/294 |
| 6,412,640 | B1 * | 7/2002 | Destanque et al. | 206/581 |
| 6,461,620 | B2 * | 10/2002 | Dobler | 424/400 |
| 6,793,077 | B1 * | 9/2004 | Kancsar et al. | 206/531 |
| 7,025,220 | B2 * | 4/2006 | Verespej et al. | 220/259.1 |
| 2004/0003825 | A1 * | 1/2004 | Kelly | 132/301 |
| 2006/0027481 | A1 * | 2/2006 | Gelardi et al. | 206/581 |

FOREIGN PATENT DOCUMENTS

| | | |
|---|---|---|
| FR | 2740013 | 4/1997 |
| FR | 2821061 | 8/2002 |
| WO | WO 88/07825 | 10/1988 |
| WO | WO 97/15910 | * 5/1997 |

* cited by examiner

Fig. 1
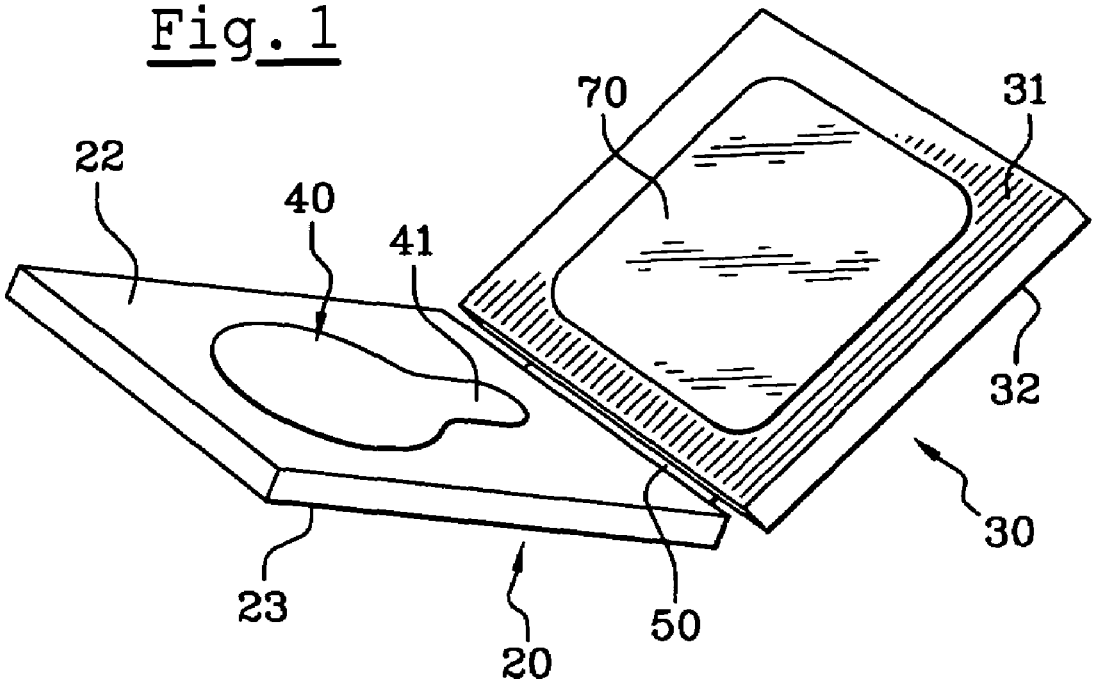
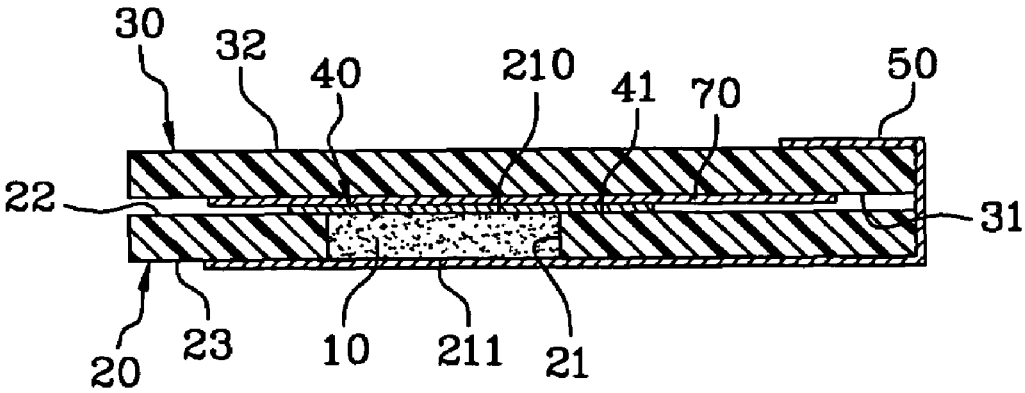
Fig. 2

Fig. 4
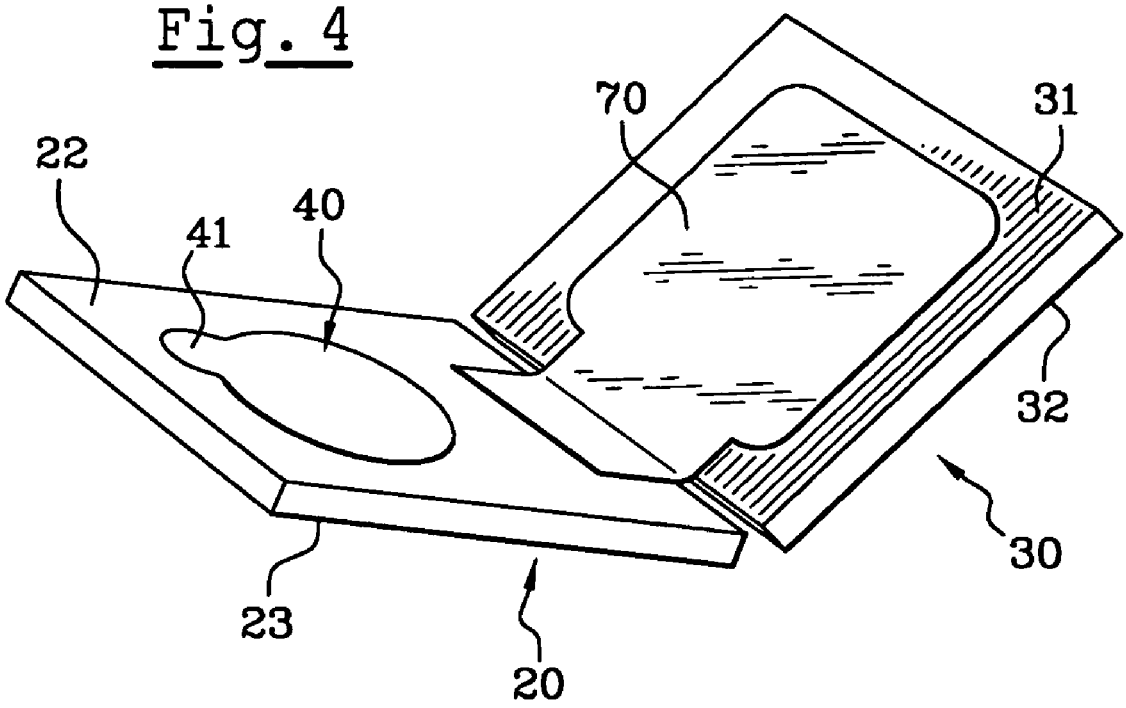
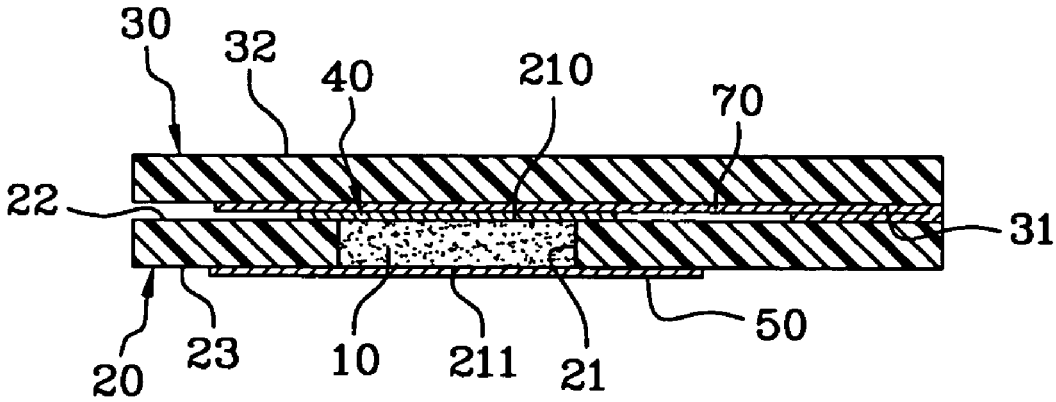
Fig. 5

PACKAGING A PRODUCT AND PACKAGING METHOD

CROSS-REFERENCE TO RELATED APPLICATIONS

This document claims priority to French Application Numbers 02 13758, filed Nov. 4, 2002, and 02 13759, filed Nov. 4, 2002 and U.S. Provisional Application Nos. 60/428,705, filed Nov. 25, 2002, and 60/428,709, filed Nov. 25, 2002, the entire content of which is hereby incorporated by reference.

FIELD OF THE INVENTION

The present invention relates to a device for packaging a product. The invention is particularly advantageous for packaging a solid cosmetic product, in the form of a sample.

BACKGROUND OF THE INVENTION

Discussion of Background

It is common to distribute cosmetic product samples in magazines, for example, by combining them with an advertisement page. For packaging cosmetic products in sample form, use is particularly made of tubes or bottles with small dimensions. However, such packaging may be difficult to distribute in magazines for advertising purposes because of its size. Other packaging, for example sachets which contain liquid or cream products, or tissues impregnated with liquid products, may be easier to insert into magazines. Nevertheless, it can be difficult to use sachets for certain solid products, for example compacted powders.

Documents FR 2,740,013 and U.S. Pat. No. 2,061,139 describe packaging for a sample of a cosmetic product in solid or paste form, which is intended to allow the sample to be distributed for advertising purposes by insertion into a publication. The packaging consists of a plate which has a central cavity into which a cup that contains the product sample is inserted. The cup is fixed by an adhesive sheet attached to one face of the plate. A capsule is placed on the other face of the plate in order to close off the cavity containing the cup. Although this packaging arrangement is partially in the form of a plate, the arrangement is relatively thick due to the presence of the cup.

Patent Application FR 2,821,061 and U.S. Pat. No. 5,161,688 describe a make-up sample which obviates the cup, with the product being inserted directly into a cavity. The cavity is closed on both sides by an adhesive film.

None of the above devices is provided with a lid. However, it may be advantageous to produce a sample which mimics a make-up case, that is to say one which has a container for the product and a lid. Patent Application WO 88/07825 describes this type of packaging. In particular, the packaging includes two credit-card type plates, which are joined together by two adhesive stickers forming a hinge. The stickers forming the hinge lie on the inner faces when the two plates are superimposed. Two holes, which open onto each face of the plate and contain a cosmetic product, pass through a first plate. An adhesive film covers the outer face of the plate so as to close off one opening of the holes, hence forming the bottom of the compartment for the product. Such packaging, which has two stickers forming a hinge, is not aesthetically pleasing. The packaging also has a relatively large number of constituent elements. Because the number of components can increase the cost to manufacture the components and/or the last to assemble the components, it is preferable to limit the number of components, particularly in sample-type packaging.

SUMMARY OF THE INVENTION

It is therefore one of the objects of the invention to provide a device for packaging a product, in particular a cosmetic product, which avoids or reduces the draw-backs of the prior art.

It is, in particular, an object of the invention to provide a device which is compact while resembling a make-up case, for example.

It is also an object of the invention to provide a device which is simple to produce and inexpensive.

It is likewise an object of the invention to provide a device in which, when the packaging is opened, the product has a visible surface which is acceptable in aesthetic terms and, in particular, which has a uniform surface.

It is yet another object of the invention to provide a simple and inexpensive method for packaging a product.

According to the invention, these objects are achieved by providing a device for packaging a product, with the device particularly advantageous for a make-up product, and more particularly for a make-up sample. The device includes a support preferably having a flat overall shape with two faces. The support includes at least one cavity which opens onto at least one face through a first opening, with the cavity containing the product. The device further includes a lid, also preferably having a flat overall shape, articulated to the support.

According to one advantageous form of the invention, the device includes a support and a lid that are articulated to each other by:

i) a sticker forming a mirror adhesively bonded onto one of the faces of the lid and onto one of the faces of the support; and/or ii) an adhesive sheet fixed onto one face of the lid and onto one of the faces of the support, with the adhesive sheet closing off a second opening of the cavity, which is formed on the face of the support on the opposite side from the face containing the first opening.

The sticker forming the bottom of the compartment, or the sticker forming a mirror, also constitutes a hinge for the device, which thereby limits the number of constituent elements of the device and therefore the steps involved in producing the device. Furthermore, in order to produce the hinge, it is easier for a single sticker to be positioned correctly than two small ones. An inexpensive packaging device is thus obtained. Furthermore, the sticker forming the bottom may also be used to decorate the outer face of the lid, for example, by printing on it beforehand—which is less expensive than printing a declaration or design directly on the lid.

The lid may be capable of resting on the support so as to at least partly cover the face of the support onto which the first opening opens.

According to one example, the lid may be capable of covering all of the face of the support, so as to provide a device which resembles a case as much as possible.

The adhesive sheet may be formed by one or more layers of a material, e.g., selected from thermoplastic materials, in particular polyolefins or polyesters, and aluminum. A layer of aluminum will advantageously be used in the case of multilayer structures, which ensures good conservation or preservation of the product.

The adhesive sheet may be covered with printing, for example, writing which relates to the product or, alternatively, a decorative pattern.

The sticker forming a mirror may be formed, e.g., by one or more layers of a material selected from thermoplastic materials, in particular polyolefins or polyesters, and aluminum, and a layer of paint forming a mirror.

The device may further include a removable capsule (or, in other words, a closure or cover) removably closing off the first opening. With this arrangement, the capsule can be removed prior to the first use to access the product. The product is thereby protected, at least before first use. The cover may be bonded onto the first face of the support by means of an adhesive, so that it can be detached, and preferably the cover is bonded so that it can also be reattached at least once. It might have no adhesive function in a region intended to face the first opening. The cover can optionally also have a gripping region making it possible to hold the cover in order to detach it from the support, at least in part. The capsule may be made of a transparent material so that the product can be seen. The cover can be made, for example, of a thermoplastic material, in particular polyester or polypropylene.

According to another aspect, the invention relates to a method for packaging a product, such as a cosmetic product, in a device as described above, with the hinge formed by the adhesive sheet. The method includes:

a) forming a plate so as to delimit the support joined to the lid;

b) forming the cavity in the support;

c) forming a groove between the support and the lid on at least one face of the plate;

d) removably closing off the first opening by means of the removable capsule or closure which is to be removed prior to first use to access the product;

e) introducing the product into the cavity via the second opening;

f) closing off the second opening by adhesively bonding the adhesive sheet onto the second face of the support;

g) folding the lid along the groove and adhesively bonding the adhesive sheet onto the lid.

The invention also relates to a method for packaging a product, such as a cosmetic product, in a device as described above, with the hinge formed by the sticker forming a mirror. The method includes:

a') forming a plate so as to delimit the support joined to the lid;

b') forming the cavity in the support;

c') forming a groove between the support and the lid on at least one face of the plate;

d') removably closing off the first opening by means of the removable capsule or closure which is to be removed prior to first use to access the product;

e') adhesively bonding the sticker forming a mirror partly onto the lid and partly onto the support;

f') introducing the product into the cavity via the second opening;

g') closing off the second opening by adhesively bonding the adhesive sheet onto the second face of the support;

h') folding the lid along the groove.

Such methods make it possible to provide a device in which the product's user-accessible surface is the one which corresponded to the bottom of the cavity when filling, so that the visible surface is perfectly uniform. Steps a), b), c), a'), b') and c') may be obtained by cutting out or, alternatively, by molding. These steps or some of these steps may be carried out at the same time or, in the case of cutting out, they may be carried out successively. Accordingly, it is to be understood that the listing of the various methods steps does not mean that the steps need be carried out in the order listed, as alternate sequences are possible and steps can be carried out at the same time.

BRIEF DESCRIPTION OF THE DRAWINGS

Other characteristics and advantages of the invention will become apparent from the following detailed description, particularly when considered in conjunction with the drawings in which:

FIG. 1 illustrates a perspective view of a first embodiment of a packaging device according to the invention;

FIG. 2 represents a view in section of the device illustrated in FIG. 1;

FIG. 4 illustrates a perspective view of a second embodiment of a packaging device according to the invention;

FIG. 5 represents a view in section of the device illustrated in FIG. 4.

DETAILED DESCRIPTION OF THE PREFERRED EMBODIMENTS

Figure 3A:
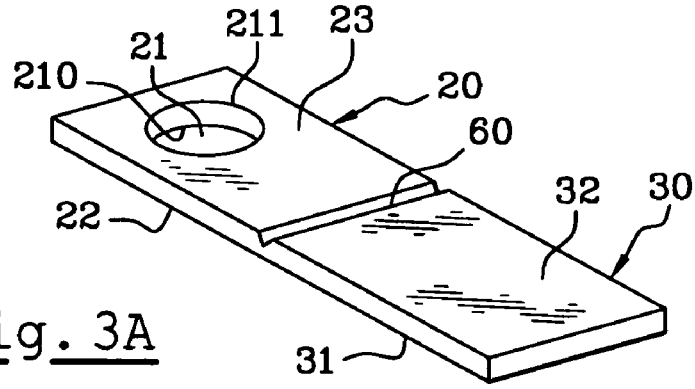
FIGS. 3A to 3F schematically illustrate the various steps of the packaging method according to the invention.

The device according to the invention, which is represented in FIGS. 1 and 2, has a rectangular support 20 in the form of the credit-card type arrangement which, in its thickness, has a cavity 21 intended to hold the product, as well as lid 30 which is articulated to the support 20 and which is also in the form of the credit-card type arrangement. It is to be understood that the support and the lid may have any other shape, for example, they may be square, round, oval, etc.

The support 20 has two flat and parallel faces 22 and 23, onto each of which the cavity 21 opens. The cavity 21 therefore has two openings 210, 211, with one provided on each face 22 and 23 of the support. The support 20 has a small thickness on the order of one millimeter, for example between 0.5 and 2 mm. According to a particular example, the support has a thickness of 0.8 mm. The cavity 21 has a circular cross section, although it may also be square, rectangular, oval or of any other shape in cross section. The cavity is intended to hold a small quantity of product, for example, 0.15 g.

A removable capsule or cover 40 is fixed onto one of the faces of the support—the upper face 22—so as to close off the opening 210 of the cavity, namely the one through which the user will be able to access the product. It is, for example, a glazed polyester-type sticker which is adhesively bonded onto the upper face of the support. A transparent sticker will preferably be selected so as to allow the user to see the product present in the packaging.

The sticker for the cover 40 can be covered with a semi-permanent adhesive allowing it to be held correctly in contact with the face, so as to close the opening while being easy to remove from the face. Advantageously, an adhesive is preferably selected which allows reattachment of the sticker to the support at least once after first opening. The removable sticker has a gripping region 41 lying at the periphery of the sticker, so as to form a tongue which is easy for the user to hold in order to remove the sticker from the support.

An adhesive film 50 is adhesively bonded onto the second face of the support—the lower face 23—so as to close off the second opening 211 of the cavity 21. This adhesive film preferably has a stronger bonding power than the removable cover 40, because it is not intended to be removed from the support. It hence constitutes the bottom of the packaging.

Printing may be provided on the opposite side of the adhesive film 50 from the adhesive face, such as a decorative pattern or, alternatively, writing which relates to the product contained in the cavity.

The lid 30 also preferably has two plane-parallel faces 31 and 32, with a first face 31 being in-tended to come to rest on the face 22 of the support. The lid 30 also has a small thickness, for example, on the order of about 0.8 mm. The face 31 may be covered with a mirror sticker 70.

The lid 30 is articulated to the support 20 by means of an adhesive film 50 which partly covers the face 32 of the lid onto which it is adhesively bonded, so that it constitutes a hinge between the support 20 and the lid 30. The film 50 extends over substantially the full width of the support and the lid, so as to keep them joined together correctly. This furthermore allows the lid and the support to have a relative pivoting movement about an axis parallel to the edge of the support and the lid, without deviating from this axis.

FIGS. 3A to 3F represent the various steps involved in production of the packaging device as described above.

First, a plate of a thermoplastic material, for example a polyvinyl chloride (PVC), a polypropylene or a polyethylene terephthalate (PET) is produced. The plate can be formed, e.g., by cutting, and is intended to form the support 20 and the lid 30. The support 20 and the lid 30 are in this case formed in a single piece, as represented in FIG. 3A. The cavity 21 can be formed at the same time by cutting. A groove 60 can also be produced at the same time between the support 20 and the lid 30 on the plate.

Instead of producing the plate as represented in FIG. 3A by cutting, it may alternatively be obtained by molding a thermoplastic material.

Figure 3B:
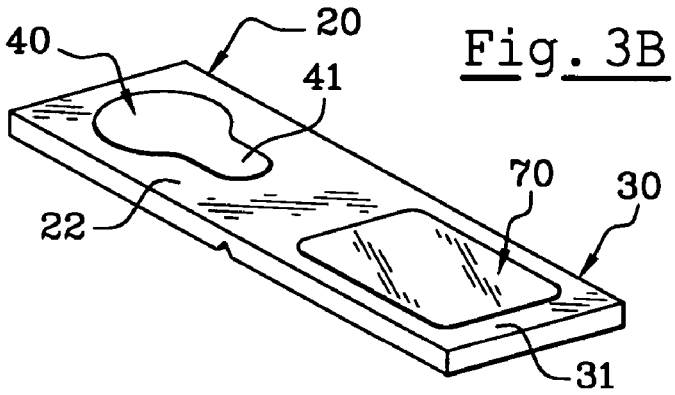

The first opening 210 is then removably closed off by means of the removable cover 40, which is adhesively bonded onto the face 22 of the support 20, and the mirror sticker 70 is adhesively bonded onto the face 32 of the lid, as represented in FIG. 3B.

Figure 3C:
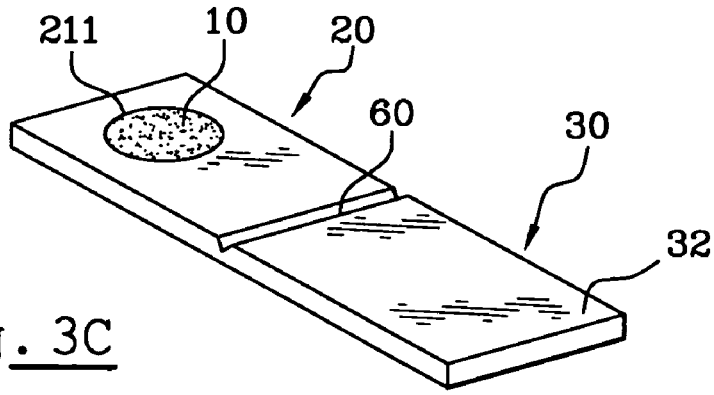
Figure 3D:
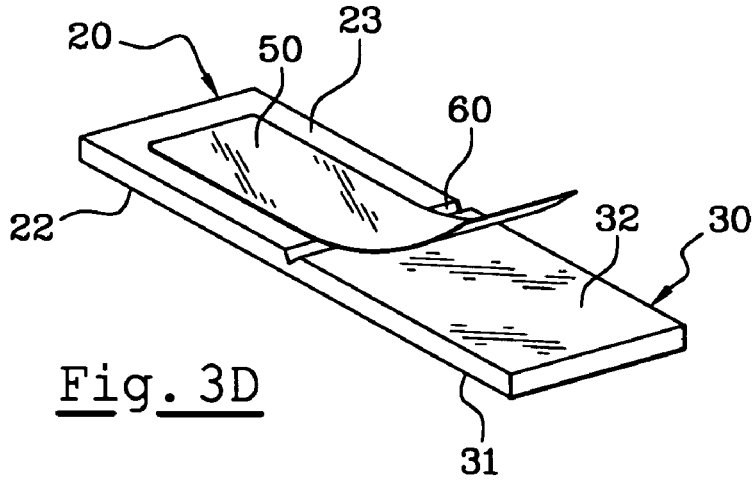
Figure 3E:
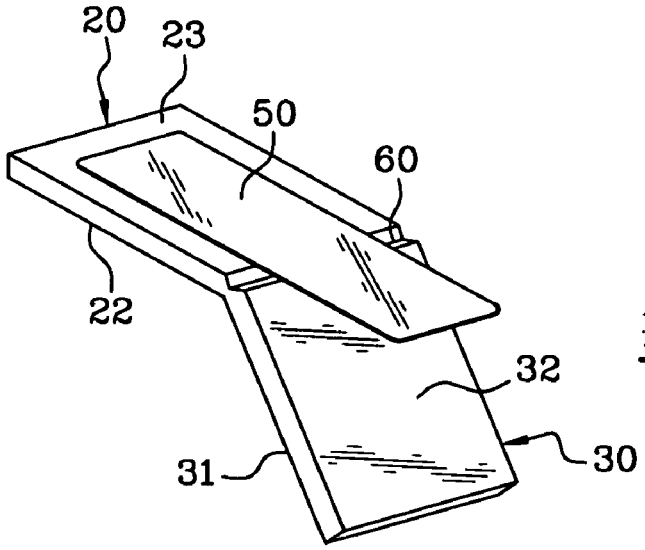

The cosmetic product 10 is then introduced in powder form through the second opening 211, into the cavity 21 which is closed in the lower part by the cover 40 (FIG. 3C). The powder which has been introduced is then compacted so as to form a pellet of product, which is then held correctly in the packaging. The quantity of product which is introduced is preferably just sufficient to fill the cavity. When too large a quantity is introduced, the excess product can be removed by suction after compacting. According to a variant, a semi-liquid or viscous product may also be poured into the cavity.

Figure 3F:
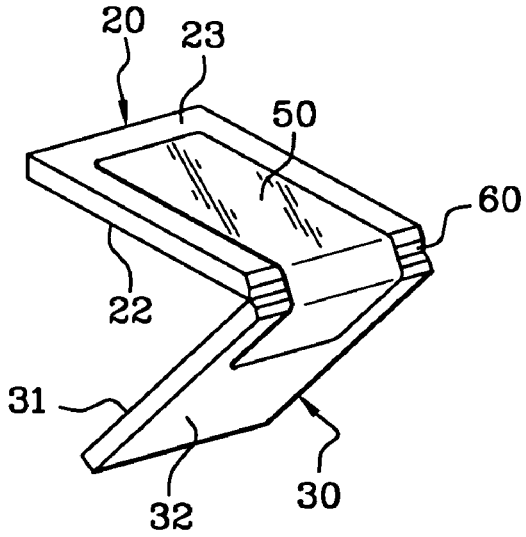

The second opening 211 is closed using the adhesive film 50 (FIG. 3D), preferably by pressing the latter onto the lower face 23 of the support with the aid of a pressure roller in order to expel air and make the film adhere to the product. The adhesive film 50 hence forms the bottom of the packaging and contributes to holding the pellet in the cavity. At the moment when the adhesive film 50 is adhesively bonded onto the face 31 of the lid, the plate is folded along the groove 60 (FIG. 3E) so as to disconnect the support 20 and the lid 30, which are immediately reconnected by the adhesive film 50 (FIG. 3F).

Packaging such as that represented in FIGS. 1 and 2 is hence obtained, which is in the form of a case. In order to access the product, the user lifts the lid 30 off the support 20 then removes the capsule or cover 40, which was affixed before filling. The user then has access to the product's surface which corresponded to the bottom of the cavity when filling, so that the visible surface is perfectly uniform.

On FIGS. 4 and 5 a second embodiment of a packaging device according to the invention has been represented which differs from the first one in the fact that the lid 30 is articulated to the support 20 by means of the mirror sticker 70 and not of the adhesive film 50. According to this embodiment, the mirror sticker 70 partly covers the face 22 of the support onto which it is adhesively bonded, so that it constitutes a hinge between the support 20 and the lid 30. The mirror sticker 70 preferably extends over substantially the full width of the support and the lid, so as to keep them joined together correctly. This furthermore allows the lid and the support to have a relative pivoting movement about an axis parallel to the edge of the support and the lid, without deviating from this axis.

FIGS. 6A to 6E represent the various steps involved in production of the packaging device as described above.

Figure 6A:
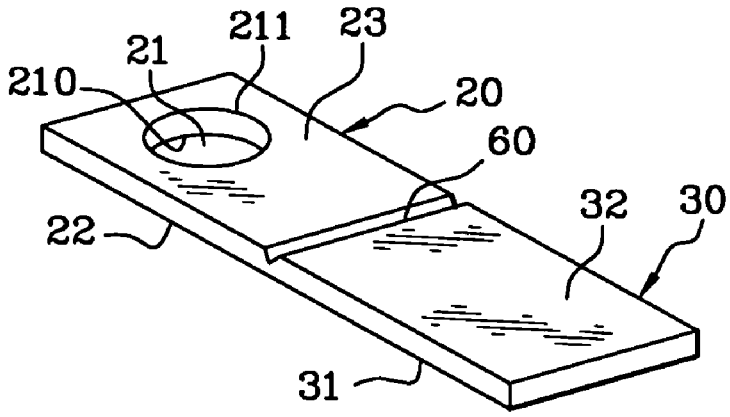
FIGS. 6A to 6E schematically illustrate the various steps of a variant of the packaging method according to the invention.

First, a plate of a thermoplastic material, for example a polyvinyl chloride (PVC), a polypropylene or a polyethylene terephthalate (PET) is produced by cutting, the plate being intended to form the support 20 and the lid 30. The support 20 and the lid 30 are in this case formed as a single piece, as represented in FIG. 6A. The cavity 21 can be formed at the same time by cutting. A groove 60 can also be produced between the support 20 and the lid 30 at the same time.

Instead of producing the plate as represented in FIG. 6A by cutting, it may alternatively be obtained by molding a thermoplastic material.

Figure 6B:
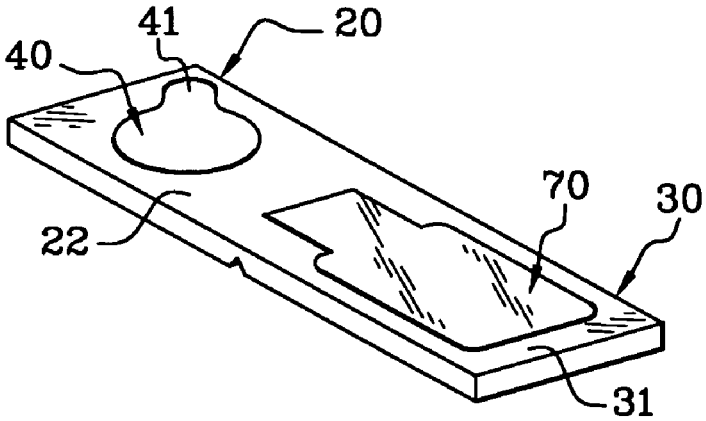

The first opening 210 is then removably closed off by means of the removable cover 40, which is adhesively bonded onto the face 22 of the support 20, and the mirror sticker 70 is adhesively bonded onto the face 31 of the lid as well as partly onto the face 22 of the support 20, as represented in FIG. 6B.

Figure 6C:
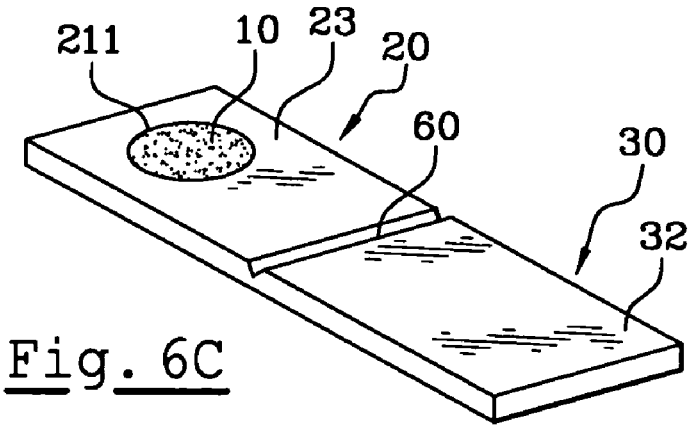
Figure 6D:
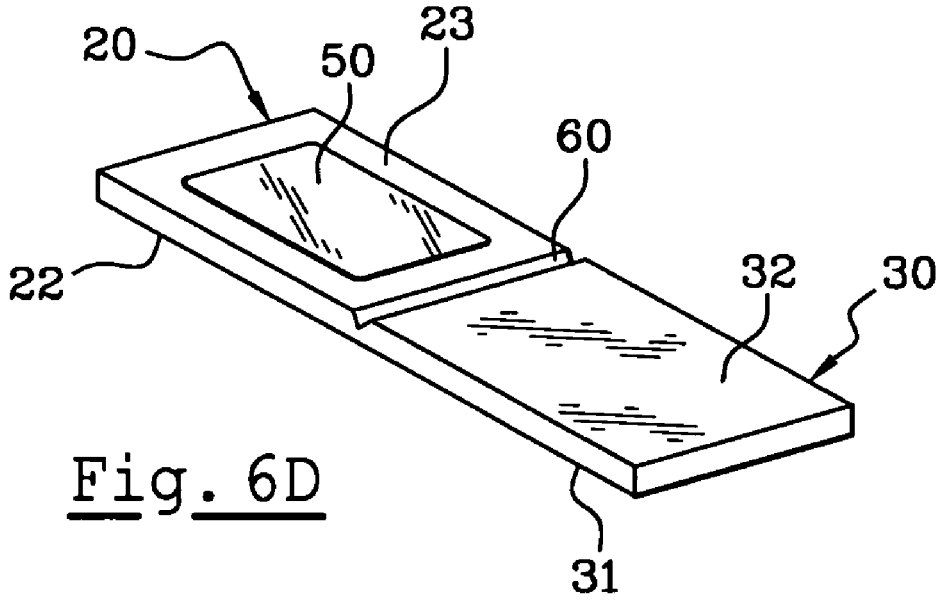
Figure 6E:
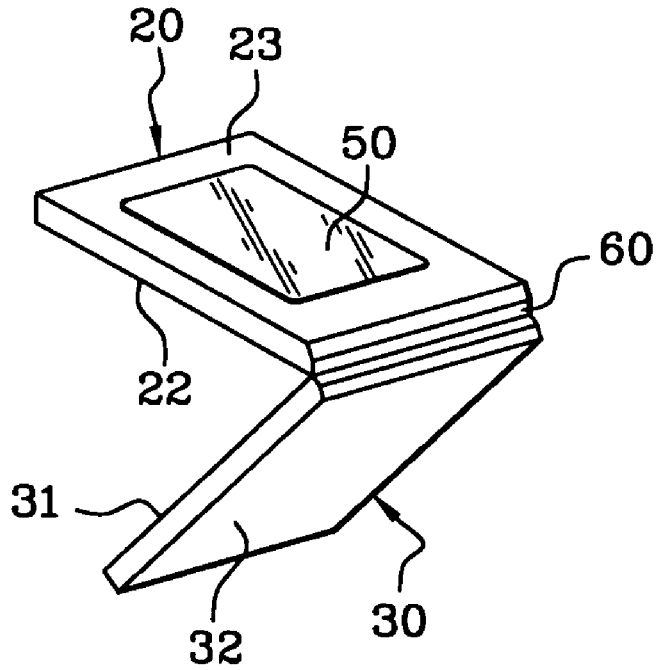

The cosmetic product 10 is then introduced in powder form through the second opening 211, into the cavity 21 which is closed in the lower part by the sticker 40 (FIG. 6C). The powder which has been introduced is then compacted so as to form a pellet of product, which is then held correctly in the packaging. The quantity of product which is introduced is preferably just sufficient to fill the cavity. When too large a quantity is introduced, the excess product can be removed by suction after compacting. According to a variant, a semi-liquid or viscous product may also be poured into the cavity.

The second opening 211 is closed using the adhesive film 50 (FIG. 6D), preferably by pressing the latter onto the lower face 23 of the support with the aid of a pressure roller in order to expel the air and make the film adhere to the product. The adhesive film 50 hence forms the bottom of the packaging and contributes to holding the pellet in the cavity.

The plate is then folded along the groove 60 (FIG. 6E) so as to separate the support 20 and the lid 30, although they remain joined together by the sticker forming a mirror 70.

Packaging such as that represented in FIG. 4 is hence obtained, which is in the form of a case. In order to access the product, the user lifts the lid 30 off the support 20 and then removes the capsule 40, which was affixed before filling. The user then has access to the product's surface (which corresponded to the bottom of the cavity when filling in the example described), so that the visible surface is perfectly uniform. She can also look in the mirror to help do her make-up.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for packaging a product comprising:

a support having a flat overall shape and having two faces, said support further including at least one cavity that passes at least partially through said support and which opens on a first face of said two faces through a first opening, and wherein said cavity contains a product;

a lid having a flat overall shape, and wherein said lid is articulated to the support; and wherein the support and the lid are articulated to each other by an arrangement comprising a sticker forming a mirror adhesively bonded onto a face of the lid and onto one of the faces of the support.

2. A device according to claim 1, wherein the lid can rest on the support so as to at least partly cover the first face of the support in which the first opening opens.

3. A device according to claim 2, wherein the lid can cover all of the first face of the support.

4. A device according to claim 1, wherein the sticker is formed by at least one layer comprising at least one thermoplastic material and a layer of paint forming a mirror.

5. A device according to claim 4, wherein said at least one thermoplastic material includes at least one of a polyolefin and a polyester.

6. A device according to claim 1, further including a removable cover removably closing off the first opening and wherein said removable cover is removed prior to use in order to access the product.

7. A device as recited in claim 1, wherein at least one of said support and said lid has a thickness in a range of 0.5 to 2.0 mm.

8. A device as recited in claim 1, wherein each of said lid and said support has a thickness in a range of 0.5 to 2.0 mm.

9. A device as recited in claim 1, wherein said product disposed in said cavity is a make-up product.

10. A device as recited in claim 1, wherein said device contains a cosmetic sample in said cavity.

11. A device as recited in claim 10, wherein said cavity has a circular cross-section.

* * * * *